US009551214B2

(12) United States Patent
Despax

(10) Patent No.: US 9,551,214 B2
(45) Date of Patent: Jan. 24, 2017

(54) METHOD FOR DETERMINING THE COMPLEX RESPONSE OF A PERMEABLE STRATUM

(76) Inventor: Damien Despax, Ain en Provence (FR)

( * ) Notice: Subject to any disclaimer, the term of this patent is extended or adjusted under 35 U.S.C. 154(b) by 506 days.

(21) Appl. No.: 14/125,129

(22) PCT Filed: May 23, 2012

(86) PCT No.: PCT/FR2012/051157

§ 371 (c)(1),
(2), (4) Date: Mar. 14, 2014

(87) PCT Pub. No.: WO2012/168614

PCT Pub. Date: Dec. 13, 2012

(65) Prior Publication Data

US 2014/0195161 A1 Jul. 10, 2014

(30) Foreign Application Priority Data

Jun. 10, 2011 (FR) ..... 11 55105

(51) Int. Cl.
*G01V 1/40* (2006.01)
*E21B 49/00* (2006.01)
(Continued)

(52) U.S. Cl.
CPC ..... *E21B 49/00* (2013.01); *E21B 34/02* (2013.01); *E21B 47/06* (2013.01); *E21B 49/008* (2013.01)

(58) Field of Classification Search
CPC ..... E21B 34/02; E21B 47/06; E21B 49/008; E21B 49/00
(Continued)

(56) References Cited

U.S. PATENT DOCUMENTS 5,172,717 A * 12/1992 Boyle ..... E21B 34/06 137/155
5,201,491 A 4/1993 Domangue
(Continued)

FOREIGN PATENT DOCUMENTS

| | | |
|---|---|---|
| FR | 2678679 A1 | 7/1991 |
| FR | 2817587 A1 | 6/2002 |
| WO | 9301391 A1 | 1/1993 |

OTHER PUBLICATIONS

International Search Report dated Mar. 18, 2013 for related PCT/FR2012/051157.

(Continued)

*Primary Examiner* — An Do
(74) *Attorney, Agent, or Firm* — Howard IP Law Group, PC

(57) ABSTRACT

A method for determining the complex response of a permeable stratum at the bottom of a producing well, the well comprising a well head fitted with an outlet valve and the bottom of the well comprising a height-adjustable pressure and flow rate sensor, comprising the following steps: periodically altering the degree to which the outlet valve is open, and, while the alteration is in progress: —measuring the pressure and flow rate in the well at the top/bottom of the stratum for a certain number of periods of alteration, after a certain delay; and —measuring the pressure and the flow rate in the well at the bottom/top of the stratum for a certain number of periods of alteration, immediately after the positioning of the sensor.

8 Claims, 1 Drawing Sheet

(51) Int. Cl.
*E21B 34/02* (2006.01)
*E21B 47/06* (2012.01)

(58) Field of Classification Search
USPC ..... 702/2, 6, 11, 12
See application file for complete search history.

(56) References Cited

U.S. PATENT DOCUMENTS

| | | | | |
|---|---|---|---|---|
| 6,026,915 | A * | 2/2000 | Smith | E21B 17/1078 166/100 |
| 6,801,857 | B2 * | 10/2004 | Despax | E21B 47/06 702/13 |
| 2004/0049346 | A1 | 3/2004 | Despax et al. | |
| 2006/0129321 | A1 | 6/2006 | Despax | |

OTHER PUBLICATIONS

Rochon, J. et al. "Method and Application of Cyclic Well Testing With Production Logging", Society of Petroleum Engineers, presented at the 2008 SPE Annual Technical Conference and Exhibition, pp. 1-15, Sep. 21-24, 2008.

* cited by examiner

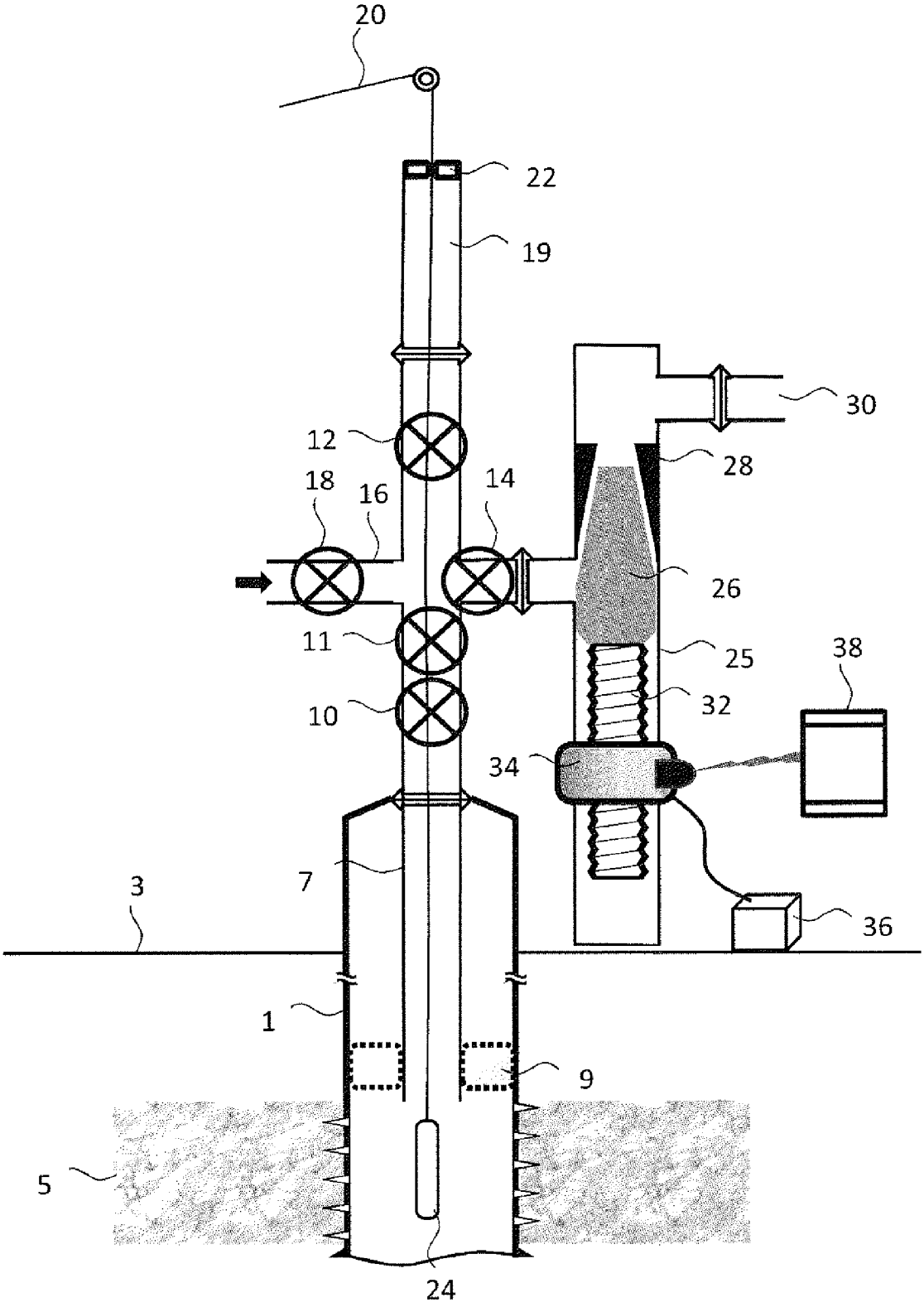
20
22
19
30
12
28
18
16
14
26
11
25
38
10
32
34
7
3
36
1
9
5
24

METHOD FOR DETERMINING THE COMPLEX RESPONSE OF A PERMEABLE STRATUM

CROSS-REFERENCE TO RELATED APPLICATIONS

This application is the national stage application under 35 U.S.C. §371 of International Application No. PCT/FR2012/051157 and claims the benefit of Int'l. Application No. PCT/FR2012/051157, filed May 23, 2012, and French Application No. 11/55105, filed Jun. 10, 2011, the entire disclosures of which are incorporated herein by reference in their entireties.

BACKGROUND

The present invention relates to methods and devices for determining the hydraulic potential of a porous permeable stratum at the bottom of a well to assess the level of production of a deposit, especially of an oil deposit. "Stratum" here designates any portion of a deposit from which an effluent originates, emerging into a well inside of a continuous interval having a height smaller than or equal to the total height of the deposit.

DISCUSSION OF THE RELATED ART

This issue has already been addressed by the present inventor in French patent application 2678679 of Jul. 5, 1991, and in French patent application 2817587 of Dec. 4, 2000, as well as in U.S. Pat. No. 7,257,491 with priority date May 22, 2002.

In French patent application 2678679, it is provided to lower down to the bottom of a well, at the level of an effluent-producing stratum, a device comprising, on the one hand, a pressure and flow measurement sensor, and on the other hand, means for at least partly stopping the well flow rate. The device is installed at successive depths of the deposit. For each depth, the shutter is periodically placed in a non-stopping position and in a partial or full stopping position, the resulting pressure and flow rate variations are measured and various characteristics of the deposit, and especially the permeability of the permeable stratum or strata as well as the possible clogging of the well, are deduced.

In French patent application 2817587, the same device is used and methods are described to more specifically determine the well clogging (SKIN). If a clogging is detected, various means are used to unclog the walls of the well.

U.S. Pat. No. 7,257,491 describes a method of evaluating the complex response of a stratum. This response, $R_{stratum}$, is defined as being a complex value corresponding to the ratio of the pressure variations, P, to the flow rate variations, Q, measured at the level of the well wall, resulting from the modulation. The US patent indicates that response $R_{stratum}$ of the permeable stratum comprised between a high elevation (high) and a low elevation (low), corresponds to formula $1/R_{stratum}=1/R_{high}-1/R_{low}$. Further, this patent briefly indicates that the pressure and flow rate modulation in the well may result from an effective action or, as in prior patent applications, from a shutter arranged at the bottom of the well, or from the surface. In this second case, it is more specifically provided to act on a fluid injection by a pump arranged at the level of the well surface. However, this patent indicates no specific advantage in causing a modulation from the surface or from the bottom of the well.

U.S. Pat. No. 7,257,491 also provides modulating the closing of the well outlet, that is, periodically closing this outlet (and no longer continuously as in techniques prior to the three above-mentioned patents and patent applications). This causes a risk of unpriming of the well when the deposit pressure is sufficiently low for it to no longer be artesian.

Thus, a problem is posed to obtain in relatively simple fashion a flow rate and pressure modulation at the well bottom.

Another issue, not mentioned previously, is the obtaining of strict characteristic parameters based on flow rate and pressure measurements performed at the bottom of the well.

SUMMARY

Thus, an object of an embodiment of the present invention is to provide a device and a method of pressure and flow rate measurement at the bottom of a well, according to a modulation applied in a simple manner to the well pressure and flow rate.

Another object of an embodiment of the present invention is to provide a method providing an exact determination of various parameters relative to the series of strata of the deposit, and especially their complex individual response $R_{stratum}$, based on flow rate and pressure measurements performed at various heights in the bottom of the well in line with the deposit.

To achieve these and other objects, an embodiment of the present invention provides a method of determining the complex response of a permeable stratum at the bottom of a producing well, the well comprising a wellhead fitted with an outlet valve and the bottom of the well comprising a height-adjustable pressure and flow rate measurement sensor, comprising the steps of:

- periodically modulating the degree of aperture of the outlet valve and, while the modulation is in progress:
  - measuring the pressure and the flow rate in the well at the top/bottom of the stratum for a number of modulation periods, after a given delay; and
  - measuring the pressure and the flow rate in the well at the bottom/top of the stratum for a number of modulation periods, immediately after the sensor has been installed.

According to an embodiment of the present invention, the measurement steps are repeated for other strata immediately after the installation of the sensor at the top/bottom of these other strata.

According to an embodiment of the present invention, the modulation modifies the outlet flow rate from 5 to 15%.

According to an embodiment of the present invention, the modulation comprises a superposition of several modulation periods.

According to an embodiment of the present invention, the superposition of periods comprises periods having relative to one another ratios equal to integral powers of 2.

According to an embodiment of the present invention, complex response $R_{stratum}$ of the stratum is determined:

by previously measuring and/or calculating the values of:
the local pressure p(z) in steady state measured in the well at depth z directed towards the bottom of the well, the origin being taken at the top of the stratum,
pulse ω of the modulation,
length L of the well between the top and the wall of the stratum,
compressibility c of the effluent in the casing,
average density ρ of the effluent flowing in the well between the wall and the top of the stratum, density $\rho_{stratum}$ of the effluent produced by the stratum,
tangent linearized head loss coefficient in the casing $F=\delta^2p/\delta q\cdot\delta z$,
area s of the well cross-section,
local flow rate q(z) in steady state measured in the well at depth z,
complex local pressure $P(z)=\Delta P(z)\cdot e^{i\cdot(\omega\cdot t+\phi(z))}$ of the modulation measured in the well at depth z,
complex local flow rate $Q(z)=\Delta Q(z)\cdot e^{i\cdot(\omega\cdot t+\psi(z))}$ of the modulation,
storage factor $\Delta C=c.s.L$ of a well section having a length L, and by applying the following relation:

$$\frac{1}{R_{stratum}}=\frac{\rho}{\rho_{stratum}}\cdot(X-i\cdot\omega\cdot\Delta C),$$

where X is a complex variable, and the solution of the following implicit equation:

$$X=\frac{\left(F+i\cdot\frac{\omega\cdot\rho}{s}\right)\cdot L\cdot U(X)}{R_h\cdot R_b\cdot U(X)-(R_b-R_h)},$$

where, for the sake of convenience, expression U(X) stands for the following group of complex terms:

$$U(X)=X\cdot\frac{th\left[\sqrt{\left(F+i\cdot\frac{\omega\cdot\rho}{s}\right)\cdot L\cdot X}\right]}{\sqrt{\left(F+i\cdot\frac{\omega\cdot\rho}{s}\right)\cdot L\cdot X}}.$$

According to an embodiment of the present invention, the flowmeter of the sensor is calibrated by applying the following steps:

- placing the sensor in a position corresponding to the upper limit of the deposit,
- measuring the flow rate at the well outlet, and
- determining that the value provided by the flowmeter of the sensor is the value measured at the outlet.

BRIEF DESCRIPTION OF THE DRAWINGS

The foregoing and other features and advantages of the present invention will be discussed in detail in the following non-limiting description of specific embodiments in connection with FIG. 1, which schematically shows an example of oil well installation.

DETAILED DESCRIPTION

The present disclosure is more specifically made in the case where the considered well is an oil or gas extraction well. However, it generally applies to any type of operating well.

1. Measurement Device and Method

FIG. 1 very schematically shows essential elements of such a well. The well is delimited by a casing 1 which extends from a level slightly higher than ground 3 to penetrate into a permeable deposit 5 producing effluents, at which level the casing is perforated. Inside of casing 1 extends a production pipe 7 which extends above the casing level and which stops at the level of a production shutter 9 arranged substantially at the top of the deposit. This field is essentially formed of a series of porous permeable strata having an effluent traveling therethrough, in the case considered herein, oil or a gas, and penetrating into the well and flowing up in production pipe 7.

The upper portion of the production pipe, or wellhead, comprises a set of valves, generally two first check valves 10 and 11 which are open when the well is being operated, and an upper check valve 12. An outlet tube extends from the production pipe between valves 11 and 12 and is controlled by a production valve 14 which lets out the effluent when the well is being operated. A tube 16 is also connected to the production pipe between valves 11 and 12. A fluid under pressure may be injected into tube 16, via a pump valve 18.

A cable 20 penetrates into the production pipe via an airlock 19 closed by a stuffing box 22 and supports in its lower portion a pressure and flow rate measurement sensor 24 (often called PLT, for Production Logging Tool), for example, of the type described in the above-mentioned documents of the same inventor. This sensor may enable to measure other parameters, such as temperature and pressure gradients.

Cable 20 has a function of mechanical support for the sensor and a function of electric signal exchange between the sensor and a control, measurement, and supply device, not shown.

It is here provided to add to production check valve 14 an adjustable outlet valve 25, for example, of needle valve type. This valve comprises a conical needle valve 26 capable of blanking a tapered seat 28 to let out a selected flow of effluent through an outlet 30. Needle valve 26 is for example rigidly attached to a worm 32 cooperating with a motor 34 powered by a power supply 36 controlled, possibly remotely, from a worksite computer 38.

When the well is being operated, and valves 10, 11, and 14 are open, the needle valve is controlled in open position, to periodically modulate the flow rate of the effluent. Such a modulation will for example ensure a periodic variation, sinusoidal or not, for example, in the range from 5 to 15%, for example, 10%, of the flow rate.

With this system, the periodicity of the modulation may be extremely freely selected. A modulation period in the range from a few seconds to a few hours may be selected. A superposition of several modulation periods, for example, a superposition of periods having ratios equal to integral powers of 2 relative to one another, may also be selected.

This modulation imposed to the outlet flow rate of the well results in periodic pressure variations which are transmitted to the bottom of the well, at the level of deposit 5. Pressure and flow rate measurements are then performed while the modulation is in progress by means of sensor 24 for several vertical positions of this sensor. Complex response $R_{stratum}$ of the stratum individualized by the two measurement positions can be deduced therefrom and particularly, as discussed in the above-mentioned documents of the inventor, the permeability of the producing stratum and its possible clogging between measurement positions can be deduced.

An advantage of the pressure/flow rate modulation system here is that it is particularly simple to implement since it is formed at the wellhead level and not at the well bottom. Further, it is much simpler to obtain a flow rate/pressure modulation by the above-described means than, as previously provided, by injecting with a pump an overpressurized fluid through valve 18.

Another advantage of the present invention is that, during the measurement, the well remains operated, its flow rate being only modulated by a few percents.

Another advantage of the present invention is that, during the measurement, the flowing out of the effluent is never blocked, which would risk unpriming the well in certain conditions.

Another advantage of the present invention is to enable to accelerate measurements. In known fashion, the measurements are only possible once a steady pressure modulation state appears at the bottom of the well. This steady state is only established after a time necessary for the complete disappearing of the transient flow state which spontaneously appears on starting of the forced modulation of the flow rate, after two, or even three modulation periods. Thus, the first measurement can only be performed by sensor 24 after two, or even three dead periods (and this duration may be particularly long when the periodicity of the induced disturbances is high (for example, several tens of minutes). However, the next measurements may be performed at different depths without waiting for the end of new dead periods. This does not occur if the modulation is established, as previously provided, by a well bottom shutter restarted for each new position of the sensor.

2. Determination of Complex Response $R_{stratum}$ of a Stratum Based on Pressure and Flow Rate Measurements at the Well Bottom Further, the present invention provides a method of determining complex response $R_{stratum}$ of a stratum based on more accurate pressure and flow rate measurements than those described in the prior documents of the inventor. In these prior documents, and particularly in U.S. Pat. No. 7,257,491, it is indicated that the complex response of a stratum to be studied between a high elevation and a low elevation corresponds to formula: $1/R_{stratum}=1/R_{high}-1/R_{low}$.

This does not take into account various correction parameters which may substantially alter the results by a proportion which may range up to 10%.

A producing stratum debiting in a circular well of constant cross-section in steady state is considered. In this state, a flow rate modulation wave of constant pulse is super-posed, after which, by means of a measurement sensor, the complex local response of the effluent at two points respectively located, for one, in lines with the upper limit or top and, for the other, in line with the lower limit or wall of the producing stratum assumed to be homogeneous, is measured. To determine the complex response of this stratum based on these two measurements, the well shape, and the physical properties of the effluent are defined and the following physical parameters are first determined.

Notations

Hereafter, the following references are used:

- t (s) for time,
- z (m) for the depth directed towards the bottom of the well, the origin being taken at the top of the stratum,
- p(z) (Pa) for the local pressure in steady state measured in the well at depth z,
- ω ($s^{-1}$) for the modulation pulse,
- L (m) for the length of the well between the top and the wall of the stratum,
- c ($Pa^{-1}$) for the compressibility of the effluent in the casing,
- ρ ($kg \cdot m^{-3}$) for the average density of the effluent flowing in the well between the wall and the top of the stratum,
- $\rho_{stratum}$ ($kg \cdot m^{-3}$) for the density of the effluent produced by the stratum,
- $F=\delta^2 p/\delta q \cdot \delta z$ ($Pa \cdot s \cdot m^{-4}$) for the tangent linearized head loss coefficient in the casing,
- s ($m^2$) for the area of the well cross-section,
- q(z) ($m^3 \cdot s^{-1}$) for the local flow rate in steady state measured in the well at depth z,
- $P(z)=\Delta P(z) \cdot e^{i \cdot (\omega \cdot t+\Phi(z))}$ (Pa) for the complex local pressure of the modulation measured in the well at depth z,
- $Q(z)=\Delta Q(z) \cdot e^{i \cdot (\omega \cdot t+\psi(z))}$ ($m^3 \cdot s^{-1}$) for the complex local flow rate of the modulation,
- $\Delta C=c.s.L$ ($m^3 \cdot Pa^{-1}$) for the storage factor of a well section of length L.

In the following, the lower portion of a measurement area located in line with the wall of the producing stratum or below is marked with an index b and the upper portion of a measurement area located in line with the top of the producing stratum or above is marked with an index h.

Further, a complex variable X is defined as the solution of the following implicit equation:

$$X = \frac{\left(F + i \cdot \frac{\omega \cdot \rho}{s}\right) \cdot L \cdot U(X)}{R_h \cdot R_b \cdot U(X) - (R_b - R_h)} \tag{1}$$

where, for the sake of convenience, expression U(X) stands for the following group of complex terms:

$$U(X) = X \cdot \frac{th\left[\sqrt{\left(F + i \cdot \frac{\omega \cdot \rho}{s}\right) \cdot L \cdot X}\right]}{\sqrt{\left(F + i \cdot \frac{\omega \cdot \rho}{s}\right) \cdot L \cdot X}}. \tag{2}$$

It should be noted that complex variable X and expression U(X) have the dimension of the inverse of a complex local response.

Method of Determining $R_{stratum}$

Complex response $R_{stratum}$ of a stratum is desired to be determined from the two complex local responses determined in the bottom of the well respectively at depths $z_b$ and $z_h$ by relation:

$$R(z) = \frac{P(z)}{Q(z)} = \frac{\Delta P(z)}{\Delta Q(z)} \cdot e^{-i \cdot (\psi(z)-\phi(z))} (\mathrm{Pa} \cdot \mathrm{s} \cdot \mathrm{m}^{-3}).$$

To achieve this, it is started by determining a production profile along the entire height of the deposit by using sensor 24 according to a protocol well known in the art and then, by interpreting these measurements by means of one of the software packages well known in the art, the respective profiles of the steady bottom flow rate q(z), of the steady bottom pressure p(z), of the density of effluent ρ(z), of the compressibility of effluent c(z), of the virtual density corresponding to the head loss gradient $\rho_{PDC}(z)$ are determined; based on these primary profiles, the profile of the linearized tangent pressure gradient can be determined by relation:

$$F(z)=\lambda \cdot \rho_{PDC}(z) \cdot g/q(z)$$

where λ is a dimensionless factor between 1.8 and 2 and where g is the terrestrial gravity acceleration (9.81 $m \cdot s^{-2}$).

In practice, ρ(z), c(z), and F(z) vary slowly along with the depth, so that representative average values can easily be obtained for an entire section of the well of moderate length by calculating simple quadratures; it is then sufficient to copy these representative average values in the relations where they are to be used.

By solving the coupled equations in P(z) and Q(z) which govern the flow of the effluent in the well between the wall and the top of the producing stratum when sustained sinusoidal periodic modulations of pulse ω are imposed therein, the inventor has shown that $R_{stratum}$ can then be expressed by relation (3):

$$\frac{1}{R_{stratum}} = \frac{\rho}{\rho_{stratum}} \cdot (X - i \cdot \omega \cdot \Delta C). \tag{3}$$

In practice, the argument of the hyperbolic tangent involved in the definition of expression U(X) is sufficiently small to be able to approximate hyperbolic tangent th(x) with x, and to replace U(X) with X. It then becomes possible to make the complex response of the producing stratum explicit based on relations (2) and (3):

$$\frac{1}{R_{stratum}} = \frac{\rho}{\rho_{stratum}} \cdot \left(\frac{1}{R_h} - \frac{1}{R_b} - i \cdot \omega \cdot \Delta C + \frac{F \cdot L}{R_b \cdot R_b} + i \cdot \frac{\omega \cdot \rho \cdot L}{s \cdot R_h \cdot R_b}\right). \tag{4}$$

Such an expression highlights the three corrective terms induced by the presence of the effluent in the well:

- Compressibility: term $i\omega\rho\Delta C/\rho_{stratum}$, which only depends on the test pulse and on the storage factor of the well portion between the two measurement points.
- Viscosity: the viscosity of the effluent induces head losses along the well, which translate as non-zero tangent gradients; the complex responses respectively measured at the top and at the bottom of the stratum explicitly appear in the expression of corrective term $\rho FL/(\rho_{stratum}R_hR_b)$, but pulse ω is only involved by its effect on the complex responses.
- Inertia: the periodic modulation of the flow rate causes surges within the effluent which has a certain mass, which in turn generate disturbing pressure waves which are taken into account by the presence of term $(\rho/\rho_{stratum})i\omega\rho L/(s,R_h,R_b)$, which would become zero if the density was zero and which depends on the pulse, both directly and by the presence of the complex responses.

It should be noted that among the three above corrective terms, the compressibility term may be significant (from 5 to 10%) if compressibility c, and thereby the well bottom storage coefficient ΔC, is high, which for example may occur for a gas; the viscosity term may be significant (from 5 to 10%) if linearized tangent head loss coefficient F is high, which is true for certain heavy oils; and the inertia term, which is always much lower than the two previous corrective terms, is however no longer negligible for fast modulations, say when the period becomes shorter than 30 seconds.

Often, the producing stratum emerges into the well by a "central" area now indexed with a "c" located between two so-called "stable" areas where no effluent penetrates or is discharged, which will be further indexed with a "b" for the lower area and with an "h" for the upper area. If the PLT measurement points have been placed in the stable areas, respectively at a distance $L_b$ under the stratum wall and at a distance $L_h$ above the stratum top, the complex response of the producing stratum can be obtained by the following relations:

$$\frac{1}{R_{stratum}} = \frac{\rho_c}{\rho_{stratum}} \cdot \left[\frac{1}{R_h} - \frac{1}{R_b} - i \cdot \omega \cdot (\Delta C_b + \Delta C_c + \Delta C_h) + T_b + T_c + T_h\right] \tag{5}$$

with:

$$J_{b,c,h} = \left(F_{b,c,h} + i \cdot \frac{\omega}{S} \cdot \rho_{b,c,h}\right) \cdot L_{b,c,h} \tag{5-1}$$

$$T_b = \frac{J_b \cdot (1 + i \cdot \omega \cdot \Delta C_b \cdot R_b)}{R_b \cdot (R_b + J_b)} \tag{5-2}$$

$$T_c = \frac{J_c \cdot (1 + i \cdot \omega \cdot \Delta C_b \cdot R_b) \cdot (1 - i \cdot \omega \cdot \Delta C_h \cdot R_h)}{(R_b + J_b) \cdot (R_h - J_h)} \tag{5-3}$$

$$T_h = \frac{J_h \cdot (1 - i \cdot \omega \cdot \Delta C_h \cdot R_h)}{R_h \cdot (R_h - J_h)} \tag{5-4}$$

Specific embodiments of the present invention have been described. Various alterations and modifications will occur to those skilled in the art. In particular, various types of settable outlet valves operable in modulation may be used. Further, although a specific mode of determination of well parameters has been described in relation with a flow rate and pressure modulation caused by the modulation of an adjustable production outlet valve, this parameter determination mode may also be used if other flow rate and pressure modulation means are implemented.

According to an aspect of the present invention, the accuracy of measurement q(z) of the local flow rate in steady state measured in the well at a depth z is desired to be improved. Indeed, flowmeters currently used in a PLT sensor are generally devices providing a proportional measurement rather than an absolute measurement. Further, the measurement provided depends on the alignment of the flowmeter with respect to the well axis. The following calibration mode is thus provided herein:

- placing the sensor flowmeter at a position corresponding to the upper limit of the deposit,
- measuring the flow rate at the well outlet by one of the conventional means currently used to measure this flow rate, and
- determining that the value provided by the flowmeter of the sensor is the value measured at the outlet.

Further, in the foregoing description, it has been assumed that the bore hole in the deposit extends vertically, but it should be clear that this bore hole may have any other inclination.

The invention claimed is:

1. A method of determining the complex response of a permeable stratum at the bottom of a producing well, the well comprising a wellhead fitted with an outlet valve and the bottom of the well comprising a height-adjustable pressure and flow rate measurement sensor, comprising the steps of:

- periodically modulating the degree of aperture of the outlet valve fitted on the wellhead and, while the modulation is in progress:
  - measuring the pressure and the flow rate in the well at the top/bottom of the stratum for a number of modulation periods, after a given delay; and
  - measuring the pressure and the flow rate in the well at the bottom/top of the stratum for a number of modulation periods, immediately after the sensor has been installed.

2. The method of claim 1, wherein the measurement steps are repeated for other strata immediately after the installation of the sensor at the top/bottom of these other strata.

3. The method of claim 1, wherein the modulation modifies the outlet flow rate from 5 to 15%.

4. The method of claim 1, wherein the modulation comprises a superposition of several modulation periods.

5. The method of claim 4, wherein the superposition of periods comprises periods having relative to one another ratios equal to integral powers of 2.

6. The method of claim 1, wherein complex response $R_{stratum}$ of the stratum is determined:

by previously measuring and/or calculating the values of:

the local pressure p(z) in steady state measured in the well at depth z directed towards the bottom of the well, the origin being taken at the top of the stratum, pulse ω of the modulation, length L of the well between the top and the wall of the stratum, compressibility c of the effluent in the casing, average density ρ of the effluent flowing in the well between the wall and the top of the stratum, density $\rho_{stratum}$ of the effluent produced by the stratum, tangent linearized head loss coefficient in the casing F=δ2p/δq·δz, area s of the cross-section of the well, local flow rate in steady state q(z) measured in the well at depth z, complex local pressure $P(z)=\Delta P(z)\cdot e^{i\cdot(\omega\cdot t+\Phi(z))}$ of the modulation measured in the well at depth z, complex local flow rate $Q(z)=\Delta Q(z)\cdot e^{i\cdot(\omega\cdot t+\psi(z))}$ of the modulation, storage factor ΔC=c.s.L of a well section of length L, and by applying the following relation:

$$\frac{1}{R_{stratum}} = \frac{\rho}{\rho_{stratum}} \cdot (X - i \cdot \omega \cdot \Delta C)$$

where X is a complex variable and the solution of the following implicit equation:

$$X = \frac{\left(F + i \cdot \frac{\omega \cdot \rho}{s}\right) \cdot L \cdot U(X)}{R_h \cdot R_b \cdot U(X) - (R_b - R_h)}$$

where, for the sake of convenience, expression U(X) stands for the following group of complex terms:

$$U(X) = X \cdot \frac{th\left[\sqrt{\left(F + i \cdot \frac{\omega \cdot \rho}{s}\right) \cdot L \cdot X}\right]}{\sqrt{\left(F + i \cdot \frac{\omega \cdot \rho}{s}\right) \cdot L \cdot X}}.$$

7. The method of claim 6, wherein the following simplified relation is applied:

$$\frac{1}{R_{stratum}} = \frac{\rho}{\rho_{stratum}} \cdot \left[\frac{1}{R_h} - \frac{1}{R_b} - i \cdot \omega \cdot (\Delta C_b + \Delta C_c + \Delta C_h) + T_b + T_c + T_h\right]$$

with:

$$J_{b,c,h} = \left(F_{b,c,h} + i \cdot \frac{\omega}{s} \cdot \rho_{b,c,h}\right) \cdot L_{b,c,h}$$

$$T_b = \frac{J_b \cdot (1 + i \cdot \omega \cdot \Delta C_b \cdot R_b)}{R_b \cdot (R_b + J_b)}$$

$$T_c = \frac{J_c \cdot (1 + i \cdot \omega \cdot \Delta C_b \cdot R_b) \cdot (1 - i \cdot \omega \cdot \Delta C_h \cdot R_h)}{(R_b + J_b) \cdot (R_h - J_h)}$$

$$T_h = \frac{J_h \cdot (1 - i \cdot \omega \cdot \Delta C_h \cdot R_h)}{R_h \cdot (R_h - J_h)}$$

where index c designates a central area of a producing stratum, index b designates the lower area, and index h designates the upper area.

8. The method of claim 1, wherein the sensor flowmeter is calibrated by applying the steps of:

placing the sensor at a position corresponding to the upper limit of the deposit, measuring the flow rate at the well outlet, and determining that the value provided by the flowmeter of the sensor is the value measured at the outlet.

* * * * *